US007210307B2

(12) United States Patent
Kuehl et al.

(10) Patent No.: US 7,210,307 B2
(45) Date of Patent: May 1, 2007

(54) REFRIGERATOR ICE STORAGE BIN WITH LID

(75) Inventors: Steven J. Kuehl, Stevensville, MI (US); Luis Antonio D. Lopes, St. Joseph, MI (US); Guolian Wu, St. Joseph, MI (US); Jocelyn Leia Pollack, New York, NY (US); Gregory R. Garavalia, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 153 days.

(21) Appl. No.: 11/053,642

(22) Filed: Feb. 8, 2005

(65) Prior Publication Data

US 2006/0174647 A1 Aug. 10, 2006

(51) Int. Cl.
*F25C 5/18* (2006.01)

(52) U.S. Cl. ..... 62/344; 220/828; 220/833

(58) Field of Classification Search ..... 62/344; 220/825, 826, 828, 833
See application file for complete search history.

(56) References Cited

U.S. PATENT DOCUMENTS

| | | | | |
|---|---|---|---|---|
| 2,503,693 | A | 4/1950 | Van Lennep | 62/108.5 |
| 3,146,601 | A | 9/1964 | Gould | 62/3 |
| 3,776,504 | A | 12/1973 | Wiley | 249/121 |
| 3,962,886 | A | 6/1976 | Hammar | 62/340 |
| 4,432,529 | A | 2/1984 | McMillan | 249/52 |
| 4,662,182 | A * | 5/1987 | Tsukiyama et al. | 62/137 |
| 4,723,693 | A * | 2/1988 | DeCoster | 222/483 |
| 4,776,478 | A * | 10/1988 | Miller et al. | 220/254.5 |
| 4,803,847 | A * | 2/1989 | Koeneman et al. | 62/68 |
| 4,899,976 | A | 2/1990 | Cederroth et al. | 249/61 |
| 4,967,995 | A | 11/1990 | Burgess | 249/70 |
| 5,111,956 | A * | 5/1992 | Jow | 220/811 |
| 5,188,744 | A | 2/1993 | Silverman | 249/121 |
| 5,196,127 | A | 3/1993 | Solell | 249/121 |
| 5,393,032 | A | 2/1995 | Cederroth | 249/61 |
| 6,050,097 | A | 4/2000 | Nelson et al. | 62/137 |
| 6,082,130 | A | 7/2000 | Pastryk et al. | 62/344 |
| 6,578,047 | B1 * | 6/2003 | Deguchi | 707/104.1 |

FOREIGN PATENT DOCUMENTS

KR 2003-389810 * 1/2003

* cited by examiner

*Primary Examiner*—William E. Tapolcai
(74) *Attorney, Agent, or Firm*—Robert O. Rice; Stephen Krefman; John F. Colligan

(57) ABSTRACT

A refrigerator having a freezer compartment having an ice maker disposed within the freezer compartment for forming ice pieces and an ice storage bin removably mounted to freezer compartment door below the ice maker having an open top receptacle for receiving ice pieces from the ice maker. The ice storage bin has a movable lid assembly including a frame removably mounted to the top of the ice storage bin and two lid members mounted to the frame. At least one lid member is pivotally mounted to the frame to close the receptacle when pivoted to a generally horizontal position and to open the receptacle when pivoted to a generally vertical position. The pivotal lid member is biased to the generally horizontal position.

7 Claims, 3 Drawing Sheets

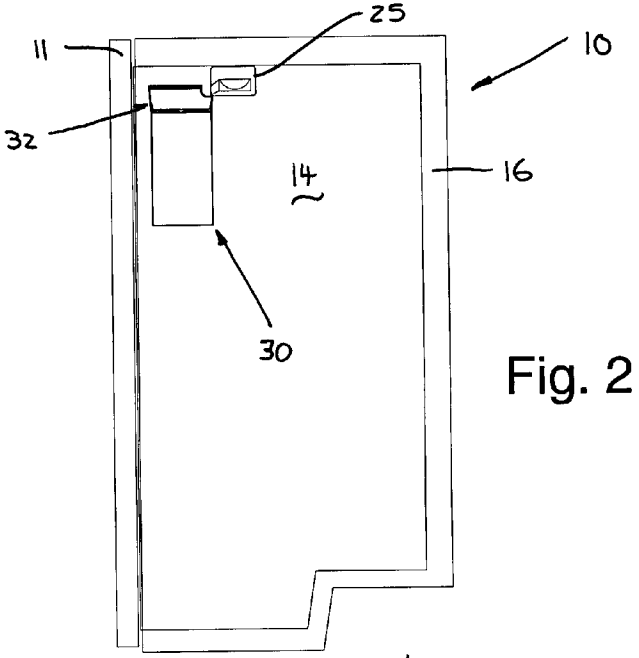
Fig. 2
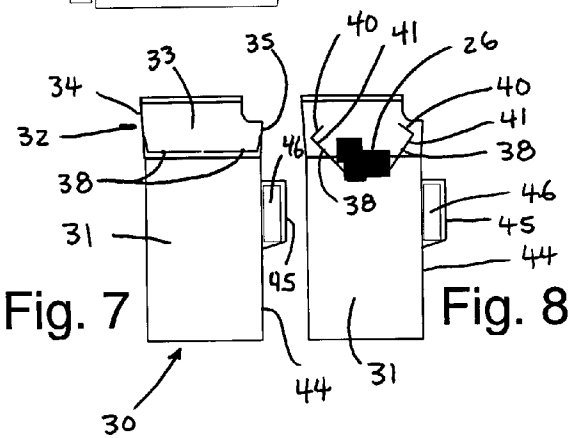
Fig. 8
Fig. 7
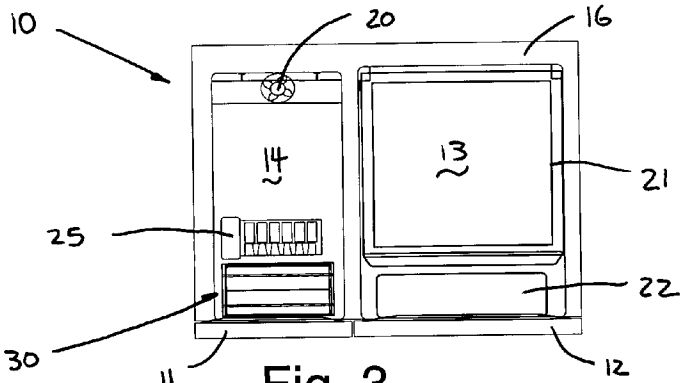
Fig. 3
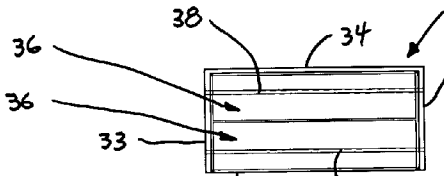
Fig. 4
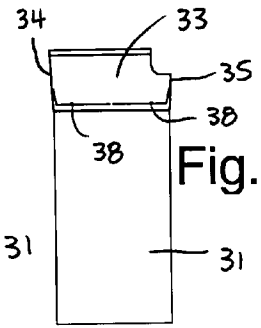
Fig. 6
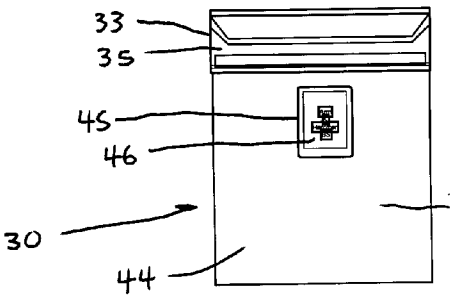
Fig. 5

REFRIGERATOR ICE STORAGE BIN WITH LID

BACKGROUND OF THE INVENTION

The invention relates to an ice storage bin for a refrigerator freezer having an automatic ice maker.

Automatic ice makers and ice dispensers are well known for household refrigerator freezers. One customer complaint is ice cubes with acquired odor and taste resulting from food odors and gases circulated within the refrigerator and freezer compartments. As refrigerated air is circulated in a refrigerator freezer some of the refrigerated air passes across the ice maker tray and the ice cube storage bin. The food odors and gases can be brought into solution in the water forming the ice cubes while they are forming or during any melting or can be effectively plated onto the surface of the ice cubes by Vanderwaals forces. One solution to reduce the transfer of food odors and flavors to ice cubes would be isolate the ice maker and ice cube storage bin in a separate compartment cooled by a separate evaporator. Even in a separate compartment ice cubes could pick up odors and flavors when the ice cube storage bin is accessed. Providing a separate compartment and evaporator is expensive and would increase the complexity of the refrigerator freezer.

SUMMARY OF THE INVENTION

The invention relates to a refrigerator freezer having an ice maker in the freezer compartment located in the freezer compartment and an ice storage bin for adjacent the ice maker for receiving ice pieces harvested by the ice maker. The ice storage bin can have an open top receptacle with a movable lid for closing the open top of the receptacle to allow ice pieces to enter the receptacle from the ice maker.

The movable lid the lid can include two lid members with at least one of the lid members pivotally mounted on a horizontal axis to pivot between a generally horizontal closed position and a generally vertical open position. The pivotally mounted lid member can be biased toward the generally horizontal closed position by gravity.

The pivotally mounted lid member opens to the generally vertical position when ice pieces fall on the lid members.

The lid members can be mounted to a frame removably mounted to the top of the receptacle. One lid member can be fixed to the frame in a generally horizontal position and one lid member can be pivotally mounted to the frame.

In another aspect the invention relates to a refrigerator including a freezer compartment having an access opening and a closure member for closing the access opening. The refrigerator can include an ice maker disposed within the freezer compartment for forming ice pieces and an ice storage bin removably mounted to the closure member. The ice storage bin can be mounted below the ice maker and can have an open top receptacle for receiving ice pieces from the ice maker and having a bottom opening for dispensing ice pieces from the ice storage bin. The ice storage bin can have a movable lid assembly including a frame removably mounted to the top of the ice storage bin and two lid members mounted to the frame. One lid member can be pivotally mounted to the frame to close the receptacle when pivoted to a generally horizontal position and to open the receptacle when pivoted to a generally vertical position. The pivotal lid member can be biased to the generally horizontal position.

One lid member can be pivotally mounted to the frame and one lid member can be fixed to the frame. The pivotal lid member in the closed position and the fixed lid member can be inclined toward the centerline of the receptacle. Ice pieces falling on the lid members cause the pivotal lid member to pivot to the generally vertical open position allowing the ice pieces to fall into the receptacle.

An adsorption odor filter can be mounted to the exterior of the ice storage bin.

BRIEF DESCRIPTION OF THE DRAWINGS

FIG. 2 is a schematic sectional side view of the freezer compartment of the refrigerator freezer of FIG. 1;

FIG. 3 is a schematic sectional top view of the refrigerator freezer of FIG. 1;

FIG. 4 is a schematic top view of one embodiment of an ice storage bin according to the invention;

FIG. 5 is a schematic front view of the ice storage bin according to the invention having an odor filter on the front wall;

FIG. 6 is a schematic side view of the embodiment of the ice storage bin in FIG. 4;

FIG. 7 is a schematic side view of the embodiment of the ice storage bin in FIG. 5;

FIG. 8 is a schematic side view of the embodiment of the ice storage bin in FIG. 5 having ice pieces on the lid members;

DESCRIPTION OF THE INVENTION

According to the invention an ice cube storage bin for a refrigerator freezer is arranged to isolate the ice pieces from the main cooling stream and from the refrigerated air in the freezer compartment by a movable cover for the ice cube storage bin. Applicants' invention will be described in connection with a side by side refrigerator freezer. Those skilled in the art will understand that the invention can be practiced in connection with a top or bottom freezer refrigerator or a refrigerator drawer as well as a side by side refrigerator as described below. Operation of a side by side refrigerator freezer with an ice maker in the freezer compartment and an ice cube storage bin positioned on the freezer compartment door is described in U.S. Pat. No. 6,050,097 and U.S. Pat. No. 6,082,130 assigned to the assignee of this application. U.S. Pat. Nos. 6,050,097 and 6,082,130 are incorporated herein by reference.

Figure 1:
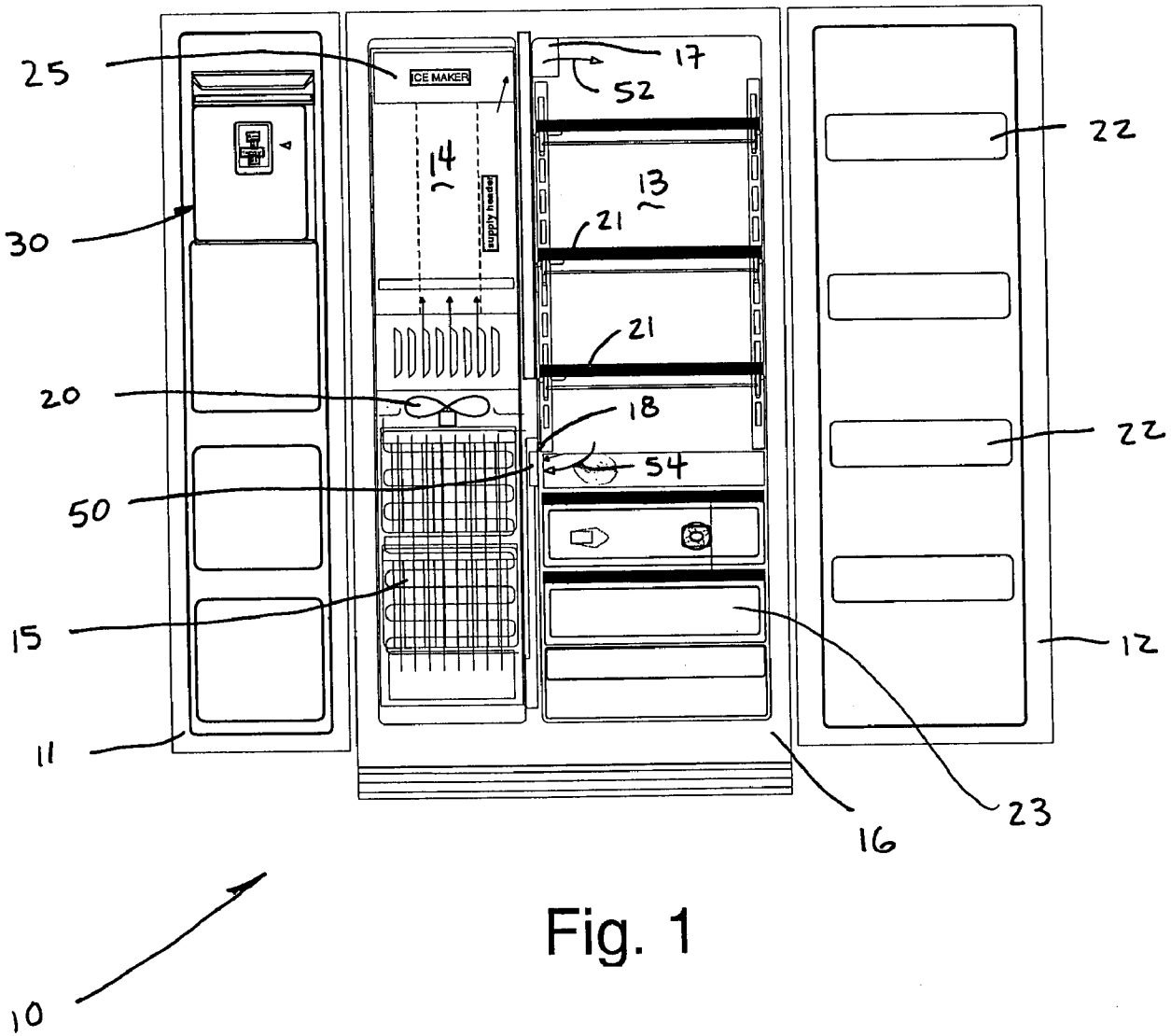
FIG. 1 is a schematic view of a side by side refrigerator freezer having an ice storage bin according to the invention.

Turning to FIGS. 1 and 2, a side by side refrigerator freezer 10 can include a refrigerator compartment 13 and a freezer compartment 14. The cabinet 16 can have a refrigerator compartment door or closure 12 and a freezer compartment door or closure 11. The refrigerator compartment 13 can have a plurality of shelves 21 that can be fixed or adjustably mounted in the refrigerator compartment 13 as is well known in the art. One or more crispers or meat pans 23 can be provided in the lower portion of refrigerator compartment as is well known in the art. Refrigerator compartment door 12 can have a plurality of door shelves 22, again as is well known in the art. Freezer compartment 14 can have an evaporator compartment 15 positioned along the rear wall of the freezer compartment that typically can be covered by an evaporator cover, not shown. An evaporator fan 20 can be provided to circulate air through the evaporator compartment and into the freezer compartment to maintain the contents of the freezer compartment below freezing, typically near 0° F. At the top of the refrigerator compartment a refrigerated air outlet 17 can allow refrigerated air to flow from the freezer compartment 14 into refrigerator compartment 13. Those skilled in the art will understand that refrigerated air outlet can be provided with a suitable control to control the amount of refrigerated air flowing into the refrigerator compartment in order to maintain the refrigerator compartment at a suitable fresh food storage temperature. A return air inlet 18 can be provided to return air from the refrigerator compartment 13 to the evaporator compartment 15 through duct 19, again as is well known in the art. Thus refrigerated air can flow into refrigerator compartment (air flow arrow 52) and out of refrigerated compartment 13 (air flow arrow 54) to maintain a selected temperature in the refrigerator compartment 13. An automatic ice maker 25 can be positioned adjacent to top wall of the freezer compartment 14 and can be provided with water for forming ice cubes as is well known in the art. An ice cube storage bin 30 can be positioned on the freezer door 11 so that ice cubes harvested by the ice maker can fall into the ice cube storage bin.

Turning to FIGS. 4 through 6, ice cube storage bin 30 can have a receptacle 31 having an open top arranged to be mounted to the inside of freezer compartment door or closure 11 as is well known in the art. Receptacle 31 can be similar to the receptacle shown in U.S. Pat. Nos. 6,050,097 and 6,082,130 referred to above and incorporated by reference. As described in the above mentioned U.S. Patents, receptacle 31 can have an opening (not shown) in the bottom wall to allow ice cubes to flow into an ice dispensing system. Receptacle 31 can have a frame 32 positioned at the top of receptacle 31. In the embodiment of the invention illustrated in FIGS. 1 through 8, frame 32 can include a front wall 35, a back wall 34 and end walls 33 that can form a chute leading from ice maker 25 to receptacle 31. Front wall 35 can have a smaller vertical extension than back wall 34 to allow frame 32 to extend under the forward edge of ice maker 25 to assure that ice pieces harvested by ice maker 25 fall into receptacle 31. Similarly, end walls 33 can include a notch adjacent front wall 35 that can form a transition from the vertical extension of back wall 34 to the smaller vertical extension of front wall 35. Frame 32 can include lid members 36 that can be pivotally mounted to frame 32 to close the open top of receptacle 31. Lid members 36 can be arranged to be normally closed to isolate ice pieces in receptacle 31 from the main air cooling stream in the freezer compartment 14. In the embodiment illustrated in FIGS. 1 through 8, frame 32 can have two lid members 36 pivotally mounted between end walls 33. While the embodiment of the invention illustrated in FIGS. 1 through 8 has two lid members those skilled in the art will understand that a single pivotal lid member could be used to close all or a portion of the top of receptacle 31. Lid members 36 can be provided with seals, if desired, along a portion of, or the entire periphery of the lid members 36 to provide further isolation of the ice in receptacle 31 from airborne contaminants. However, applicants have determined that seals are not necessary in order to obtain the benefits of the invention. Lid members 36 can be pivotally mounted to frame 32 about a pivot 38. Pivot 38 can be a rod extending through the lid members 36 as shown in FIGS. 4 and 6, or can be a pivot molded integrally with lid members 36. Pivot 38 can be molded integrally with the lid members 36 or can be inserted into an opening molded into lid members 36. Similarly a pivot 38 can be inserted into cavities formed in opposite edges of lid members 36. Lid members 36, receptacle 31 and frame 32 can be molded plastic material such as crystal polystyrene. Those skilled in the art will understand that other materials such as ABS or HIPPS can be used to form lid members 36, receptacle 31 and frame 32 if desired.

Turning to FIGS. 7 and 8 the operation of lid members 36 can be seen. Lid members 36 can include a generally vertical leg 40 and a base leg 41. Pivot 38 can be located in base leg 41 such that the lid members 36 can be gravity balanced with a bias to the "closed" position as illustrated in FIG. 7. Generally vertical legs 40 can be arranged to close against the back wall 34 and the front wall 35 respectively. As mentioned above the edges of base leg 41 can be provided with seals (not shown) to provide a seal between lid members 36 and frame 32 and between the two lid members 36. When ice maker 25 goes through a harvest cycle ice pieces 26 can fall off the edge of ice maker 25 facing freezer door 11 as described in U.S. Pat. Nos. 6,050,097 and 6,082,130 incorporated by reference above. As illustrated in FIG. 8 the weight of ice pieces 26 can cause lid members 36 to pivot downwardly allowing ice pieces 26 to fall into receptacle 31. Pivot 38 can be positioned so that lid members 36 are just gravity biased to the "closed" position so that the weight of one or more ice pieces on a lid member 36 is sufficient to pivot the lid member(s) 36 to the open position. Those skilled in the art will understand that lid members 36 can be arranged to have a small slope toward the centerline of receptacle 31 when in the "closed" position. Providing a small slope to the centerline of the receptacle can help assure that any ice pieces falling on lid members 36 will slide toward the centerline of receptacle 31 and cause the lid member to pivot to the "open" position and allow the ice piece to fall into receptacle 31. In the embodiment of FIGS. 1 through 8, lid members 36 are shown as gravity biased to the normally "closed" position. Those skilled in the art will understand that, if desired, lid members can be spring biased to the normally closed position. In the "closed" position lid member 36 can be arranged to substantially isolate the interior of receptacle 31 from the freezer compartment 14 and from the refrigerated air flowing through refrigerator freezer 10. Further, lid members 36 can provide some protection from melting for ice pieces 26 in receptacle 31 when the freezer compartment door 11 is opened.

Figure 10:
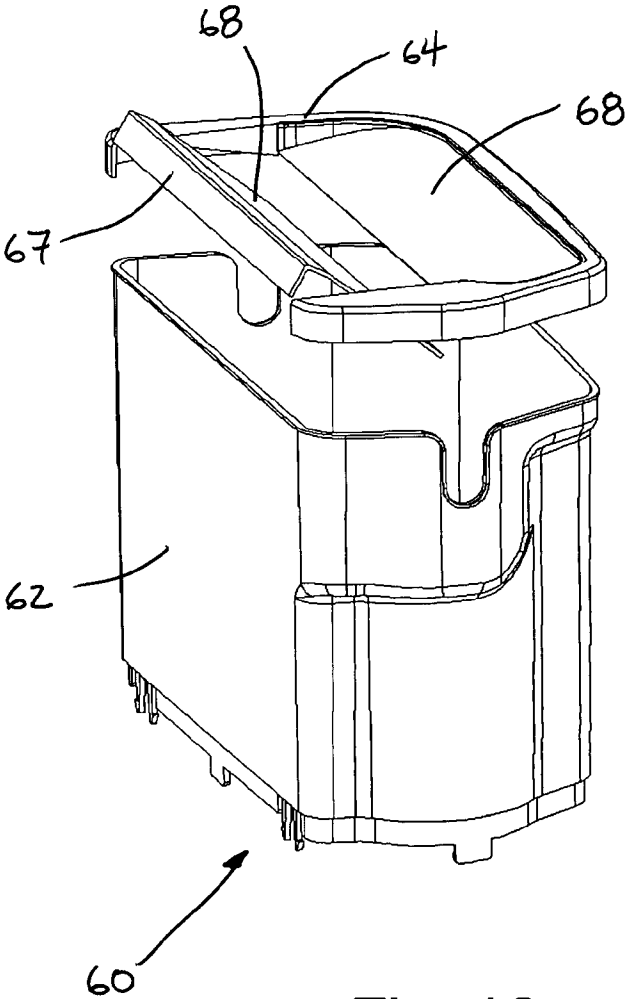
FIG. 10 is a perspective view of the ice storage bin in FIG. 9 with the frame and lid members spaced above the ice storage bin.
Figure 9:
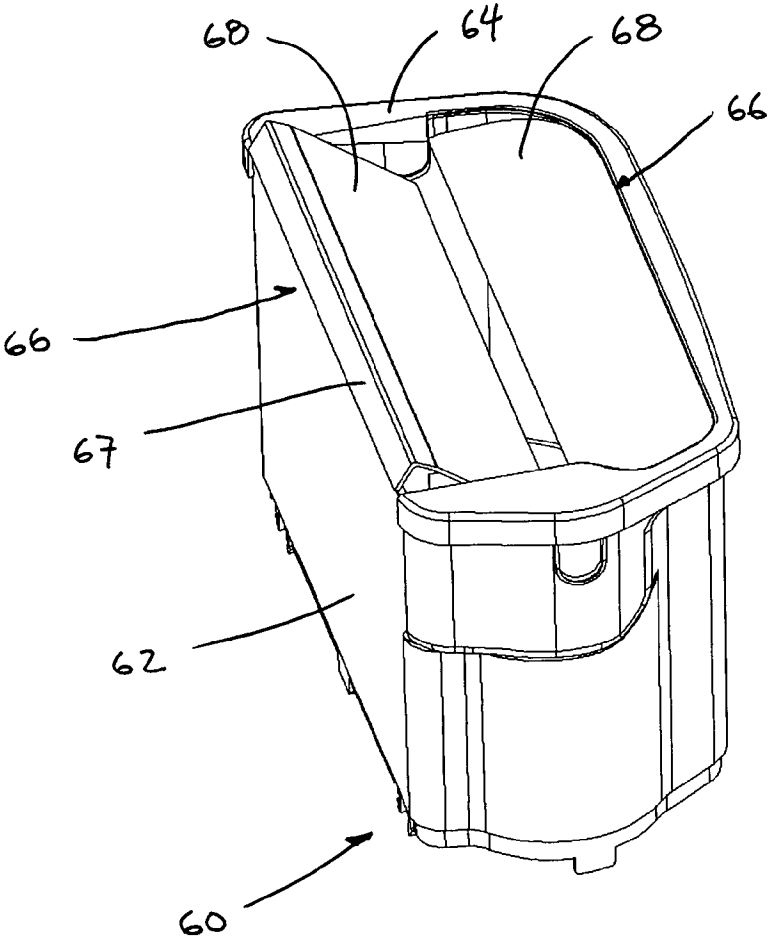
FIG. 9 is a perspective view of another embodiment of an ice storage bin according to the invention.

Turning to FIGS. 9 and 10 another embodiment of an ice storage bin 60 can be seen. Ice storage bin 60 can be positioned on the inner door panel of a freezer compartment door similar to the ice storage bins disclosed in U.S. Pat. Nos. 6,050,097 and 6,082,130 incorporated by reference above. Ice storage bin 60 can include a receptacle 62 that can have a frame 64 extending around a portion of the top of receptacle 62. Those skilled in the art will understand that frame 64 can be arranged to extend around the entire periphery of receptacle 62. Frame 64 can have a pivotal lid member 66 that can be pivotally mounted to frame 64 similar to lid members 36 in the embodiment of FIGS. 1 through 8. Lid member 66 can have a vertical leg 67 and a base leg 68. Frame 64 can also have a fixed lid member 69 that can be similar in shape to base leg 68 of pivotal lid member 66. Those skilled in the art will understand that fixed lid member 69 can be integrally formed or molded with frame 64, or can be a separate element mounted or fastened to frame 64. Pivotal lid member 66 and fixed lid member 69 can be arranged to each cover approximately one half of the open top 61 of receptacle 62. Those skilled in the art will understand that the portion of the open top 61 covered by pivotal lid member 66 or fixed lid member 69 can be more or less than approximately half if desired. Fixed lid member 69 can be fixed to frame 64 such that lid member 69 slopes downwardly slightly toward the centerline of receptacle 62. Likewise pivotal lid member 66 can be pivotally mounted to frame 64 to slope slightly downwardly toward the centerline of receptacle 62 when in the generally horizontal closed position. Applicants have found that the configuration shown in FIGS. 9 and 10 works well as described below. Base leg 68 can include a pivot (not shown) that can be similar to the pivot in the embodiment of FIGS. 1 through 8 described above. Vertical leg 67 can be arranged to "seal" against the open top 61 of receptacle 62 in the "closed" position and base leg 68 can "seal" against frame 64. Those skilled in the art will understand that if frame 64 extends fully around the periphery of receptacle 62 vertical leg 67 can be arranged to "seal" against frame 64 in lieu of or addition to the open top 61 of receptacle 62. As described above, lid member 66 can be provided with seals along a portion of, or the entire periphery of the lid member 66, if desired, to further isolate ice pieces in receptacle 62 from airborne contaminants. Likewise, lid member 66 can be spring biased instead of gravity biased to the "closed" position as shown.

In operation the embodiment illustrated in FIGS. 9 and 10 can be similar to the embodiment illustrated in FIGS. 1 through 8 with the exception that fixed lid member 69 is not movable. As described above, pivotal lid member 66 and fixed lid member 69 can be arranged to slope toward the centerline of receptacle 62. Providing fixed lid member 69 with a slope toward the centerline of receptacle 62 helps assure that ice pieces falling onto fixed lid member 69 will slide onto pivotal lid member 66. Ice pieces falling on pivotal lid member 66 or falling onto fixed lid member 69 and sliding onto pivotal lid member 66 can cause pivotal lid member 66 to pivot to the "open" generally vertical position to allow ice pieces to fall into receptacle 62. As shown in FIG. 10, frame 64 can be removably mounted on the top edge of receptacle 62. A user can remove ice storage bin 60 from the freezer compartment door for bulk dispensing of ice pieces. After removing ice storage bin 60 from the freezer compartment door, frame 64 can be removed from receptacle 62 allowing ice pieces to be easily emptied from receptacle 62. Those skilled in the art will understand that frame 32 in the embodiment of FIGS. 1 through 8 can similarly be arranged for removal for bulk dispensing of ice pieces in receptacle 32 similar to receptacle 62 in the embodiment of FIGS. 9 and 10. Those skilled in the art will also understand that one of the lid members in the embodiment of FIGS. 1 through 8 can be fixed similar to the fixed lid member 69 in the embodiment of FIGS. 9 and 10.

Turning to FIGS. 1, 5, 7 and 8, ice cube storage bin 30 can be provided with an adsorption filter 46 that can be carried in a filter housing 45 on front wall 44 of receptacle 31. Adsorption filter 46 can be a package of ARM & HAMMER® deodorizer and air freshener commonly used for adsorbing undesired odors in a refrigerator. Alternately, or in addition to an adsorption filter 46, refrigerator freezer 10 can be provided with a catalytic filter 50 can that can be positioned in return air inlet 18. Catalytic filter 50 can be a catalytic filter well known in the art for household deodorizing applications. The addition of an adsorption filter 46 and/or a catalytic filter 50 can further reduce the transfer of food odors and flavors to ice pieces stored in freezer compartment 14 by reducing the overall level of food odors and gases in the refrigerator freezer 10.

While the invention has been specifically described in connection with certain specific embodiments thereof, it is to be understood that this is by way of illustration and not of limitation, and the scope of the appended claims should be construed as broadly as the prior art will permit.

We claim:

1. A refrigerator including a freezer compartment baying an access opening and a closure member for closing the access opening, the refrigerator comprising:

an ice maker disposed within the freezer compartment for forming ice pieces;

an ice storage bin removably mounted to the closure member below the ice maker having an open top receptacle for receiving ice pieces from the ice maker and having a bottom opening for dispensing ice pieces from the storage bin;

a movable lid assembly comprising:

frame removably mounted to the top of the ice storage bin; and two lid members mounted to the frame with at least one lid member pivotally mounted to the frame to close the receptacle when pivoted to a generally horizontal position and to open the receptacle when pivoted to a generally vertical position, the pivotal lid member being biased to the generally horizontal position.

2. The refrigerator according to claim 1, wherein two lid members are pivotally mounted to the frame and are gravity biased to the generally horizontal position and the weight of the ice pieces harvested by the ice maker falling on the pivotal lid member causes the lid members to pivot to the generally vertical position allowing the ice pieces to fall into the receptacle.

3. The refrigerator according to claim 1, wherein one lid member is pivotally mounted to the frame and one lid member is fixed to the frame.

4. The refrigerator according to claim 3, wherein the pivotal lid member in the closed position and the fixed lid member are inclined toward the centerline of the receptacle whereby ice pieces falling on the lid members causes the pivotal lid member to pivot to the generally vertical position allowing the ice pieces to fall into the receptacle.

5. The refrigerator according to claim 1, further comprising an adsorption odor filter mounted to the exterior of the ice storage bin.

6. The refrigerator according to claim 1, further comprising a refrigerated air system having a catalyzing odor filter positioned in the refrigerated air system.

7. The refrigerator according to claim 1, further comprising an ice dispenser mechanism on the closure member, wherein the ice storage bin is positioned on the closure member above the ice dispenser mechanism whereby ice pieces can exit the ice storage bin through the bottom opening into the ice dispenser mechanism.

* * * * *